US011549459B2

(12) United States Patent
Chen et al.

(10) Patent No.: US 11,549,459 B2
(45) Date of Patent: Jan. 10, 2023

(54) INTERNAL COMBUSTION ENGINE WITH DUAL-CHANNEL CYLINDER LINER COOLING

(71) Applicant: Caterpillar Inc., Peoria, IL (US)

(72) Inventors: Allen Yao Chen, Dunlap, IL (US); Aaron Gary Heintz, Washington, IL (US); Jason Lee Van Farowe, Brimfield, IL (US); Thomas L. Atwell, Peoria, IL (US); David L. Lueders, Henry, IL (US); John W. Milem, Brimfield, IL (US); Suresh Babu Chennagowni, Peoria, IL (US); Khairul Hassan, Peoria, IL (US)

(73) Assignee: Caterpillar Inc., Peoria, IL (US)

( * ) Notice: Subject to any disclaimer, the term of this patent is extended or adjusted under 35 U.S.C. 154(b) by 69 days.

(21) Appl. No.: 16/790,838

(22) Filed: Feb. 14, 2020

(65) Prior Publication Data

US 2021/0254578 A1 Aug. 19, 2021

(51) Int. Cl.

| | |
|---|---|
| ***F01P 5/10*** | (2006.01) |
| ***F02F 1/16*** | (2006.01) |
| ***F02F 3/00*** | (2006.01) |
| ***F02F 7/00*** | (2006.01) |

(52) U.S. Cl.

CPC ..... *F02F 1/16* (2013.01); *F01P 5/10* (2013.01); *F02F 3/00* (2013.01); *F02F 7/007* (2013.01); *F01P 2060/04* (2013.01)

(58) Field of Classification Search

CPC ..... F02F 1/16; F02F 3/00; F02F 7/007; F01P 5/10; F01P 2060/04

USPC ..... 123/41.44

See application file for complete search history.

(56) References Cited

U.S. PATENT DOCUMENTS

| | | | | | |
|---|---|---|---|---|---|
| 3,486,488 | A * | 12/1969 | Horst | F01P 3/18 | 123/41.01 |
| 4,244,330 | A * | 1/1981 | Baugh | F02F 11/005 | 123/193.2 |
| 5,150,668 | A * | 9/1992 | Bock | F02F 1/10 | 123/41.8 |
| 5,211,137 | A * | 5/1993 | Kawauchi | F01P 3/02 | 123/41.79 |
| 5,386,805 | A * | 2/1995 | Abe | F01P 3/02 | 123/41.28 |
| 5,402,754 | A * | 4/1995 | Gunnarsson | F02F 1/16 | 123/193.2 |

(Continued)

FOREIGN PATENT DOCUMENTS

| | | |
|---|---|---|
| CN | 112196688 | 1/2021 |
| DE | 3417515 | 8/1985 |

(Continued)

*Primary Examiner* — Hung Q Nguyen
*Assistant Examiner* — Anthony Donald Taylor, Jr.
(74) *Attorney, Agent, or Firm* — Bookoff McAndrews, PLLC

(57) ABSTRACT

A cylinder liner is provided that includes a cylinder bore capable of housing a piston, a top end having an annular flange, a first cylindrical section, a second cylindrical section, and an annular ridge that separates the first cylindrical section and the second cylindrical section. When employed in an a liner bore of an engine bock, the cylinder liner provides for two channels that allow for coolant to be supplied to the cylinder liner.

20 Claims, 6 Drawing Sheets

(56) References Cited

U.S. PATENT DOCUMENTS 5,505,167 A * 4/1996 Kennedy ..... F02F 1/14
123/41.84
5,970,941 A * 10/1999 Bock ..... F02F 1/002
123/193.3
5,979,374 A * 11/1999 Jackson ..... F02F 1/163
123/193.2
6,123,052 A * 9/2000 Jahn ..... B22D 19/0081
123/193.2
7,131,417 B1 * 11/2006 Jones ..... F02F 1/102
123/193.2
7,162,798 B2 * 1/2007 Westra ..... F02F 1/16
29/888.061
8,443,768 B2 * 5/2013 Berghian ..... F02F 1/14
123/41.84
9,593,639 B2 * 3/2017 Batta ..... F02F 1/14
9,624,869 B2 * 4/2017 Batta ..... F02F 1/004
10,107,228 B2 * 10/2018 Sharma ..... F02F 1/163
10,359,000 B2 * 7/2019 Gniesmer ..... F02F 1/004
2006/0219192 A1 * 10/2006 Rasmussen ..... F02F 1/004
123/41.84
2007/0107689 A1 * 5/2007 Oogake ..... F02F 1/166
123/193.2
2008/0110423 A1 * 5/2008 Ruble ..... F02F 1/14
123/41.72
2012/0304954 A1 * 12/2012 Kiser ..... F02F 1/004
123/193.2

FOREIGN PATENT DOCUMENTS

DE 102011116587 4/2013
JP 4395002 B2 1/2010

* cited by examiner

INTERNAL COMBUSTION ENGINE WITH DUAL-CHANNEL CYLINDER LINER COOLING

STATEMENT OF GOVERNMENT INTEREST

This invention was made with government support under contract DE-EE0008476 awarded by the DOE. The Government has certain rights in this invention.

TECHNICAL FIELD

The present disclosure relates to an internal combustion engine, and more specifically to an internal combustion engine having dual-channel cylinder liner cooling.

BACKGROUND

Internal combustion engines are typically liquid-cooled. A conventional coolant system for an internal combustion engine may include a coolant pump that pumps coolant into coolant passages of the engine. In certain internal combustion engines, replaceable cylinder liners define the cylinders and, in part, the combustion chambers of the engine.

During combustion, an internal combustion engine may generate an immense amount of heat. In certain engines, a coolant passage is provided between and around the cylinder liners. Coolant may be directed through the coolant passage to cool the liners and carry heat energy away from the cylinders. Heat energy, however, is unevenly distributed in each cylinder liner since the top portion of each cylinder liner, where combustion takes place, experiences higher temperatures.

U.S. Pat. No. 8,443,768 to Berghian et al. discloses an engine cylinder liner having a primary cooling gallery and a secondary cooling gallery about an upper portion of the cylinder liner. The secondary cooling gallery has an undulating configuration that is indicated to substantially increase contact surface of the coolant in the secondary cooling gallery.

SUMMARY OF THE DISCLOSURE

In one aspect of the present disclosure, an internal combustion engine is provided including a cylinder head, a piston, and an engine block having a liner bore and a cylinder liner countersunk into the liner bore, wherein a first annular coolant channel having a channel top end and a channel bottom end is formed between the liner bore and the cylinder liner, the cylinder liner including a cylinder bore housing the piston, the piston slideably received within the cylinder bore for reciprocating between a top dead center position and a bottom dead center position, and a top end having an annular flange, wherein the channel top end is closer to the top end of the cylinder liner than the piston when at the top dead center position.

In another aspect of the present disclosure, a cylinder liner is provided including, a cylinder bore capable of housing a piston, a top end having an annular flange, a first cylindrical section acting as a first coolant groove, a second cylindrical section acting as a second coolant groove, and an annular ridge that separates the first cylindrical section and the second cylindrical section.

In another aspect of the present disclosure, a cooling system is provided including a coolant in fluid communication with a water pump, an oil cooler, a thermostat housing, a radiator, and an engine block and cylinder head assembly including a cylinder head, a piston, and an engine block having a liner bore and a cylinder liner countersunk into the liner bore, wherein a first annular channel having an annular channel top end and an annular channel bottom end is formed between the liner bore and the cylinder liner, the first annular channel; the cylinder liner including a cylinder bore housing the piston, the piston is capable of a piston stroke that includes a top dead center, a top end having an annular flange, a first cylindrical section, a second cylindrical section, and an annular ridge that separates the first cylindrical section and the second cylindrical section; wherein the annular channel top end is closer to the top end of the cylinder liner than the top dead center of the piston.

Other features and aspects of this disclosure will be apparent from the following description and the accompanying drawings.

BRIEF DESCRIPTION OF THE DRAWINGS

Further features and advantages of the invention will become apparent from the description of embodiments using the accompanying drawings. In the drawings.

DETAILED DESCRIPTION

Figure 1:
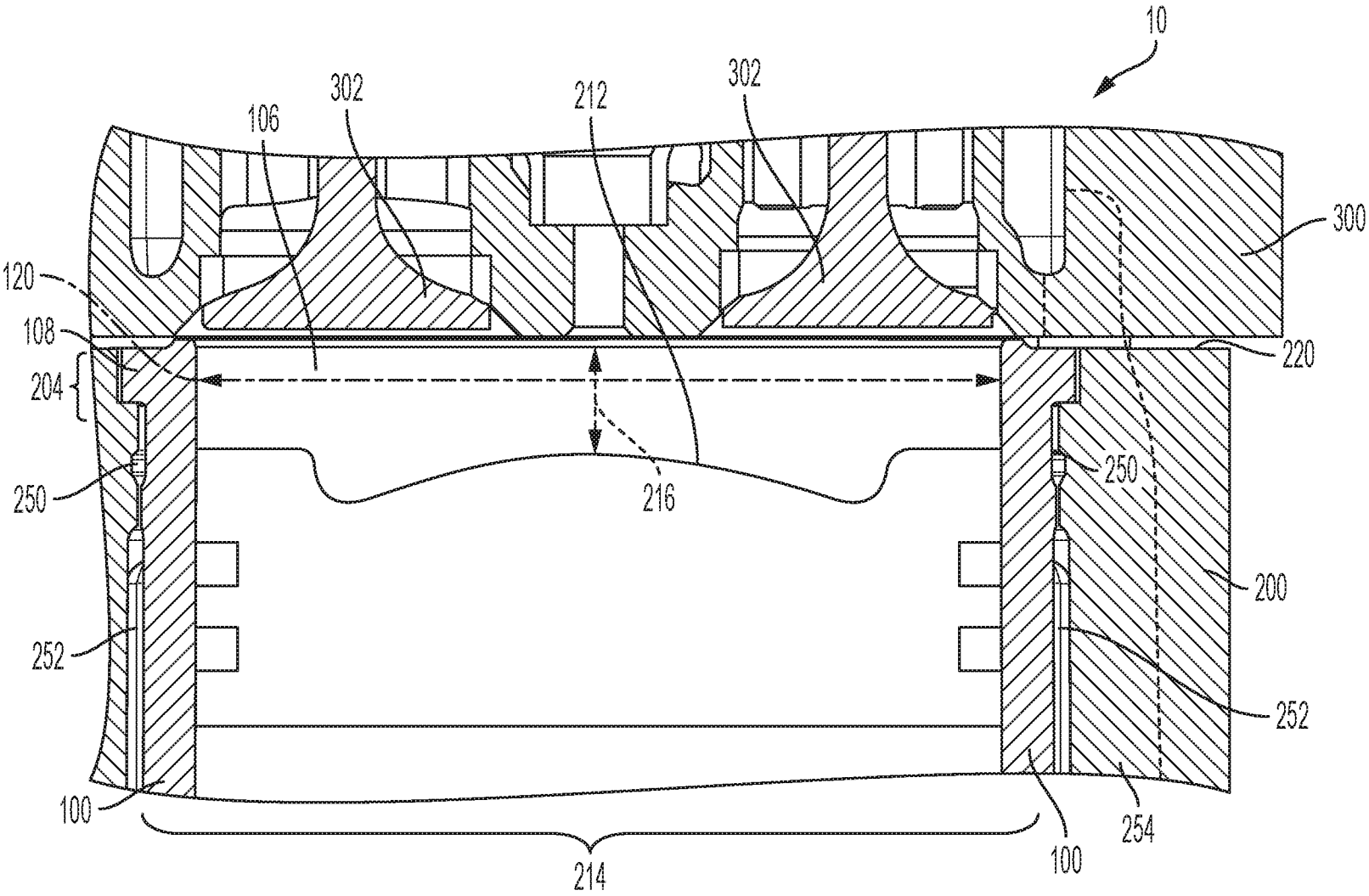
FIG. 1 is a partial cross section of a portion of an internal combustion engine including an exemplary cylinder liner housed in a liner bore of an engine block.
Figure 2:
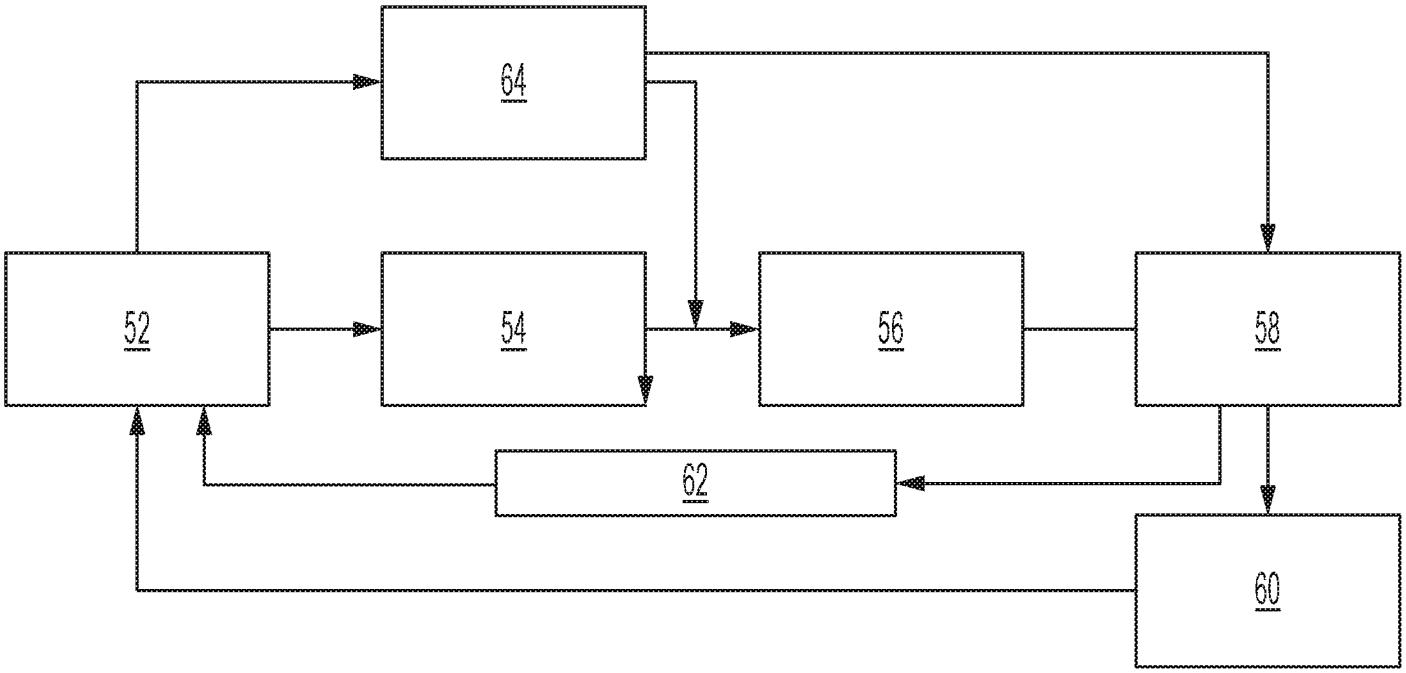
FIG. 2 is a schematic of an embodiment of an exemplary engine cooling system

Referring to the drawings, FIG. 1 is a partial cross section of a portion of an internal combustion engine 10 such as a diesel engine. The internal combustion engine 10 may provide power to various types of applications and/or machines. For example, the internal combustion engine 10 may power a machine such as an off-highway truck, a railway locomotive, an earth-moving machine, such as a wheel loader, excavator, dump truck, backhoe, motor grader, material handler, or the like. The term "machine" can also refer to stationary equipment like a generator that is driven by the internal combustion engine 10 to generate electricity FIG. 2 is a schematic of an exemplary cooling system 50. In the cooling system 50, a water pump 52 pumps the coolant into an oil cooler 54. The coolant leaves the oil cooler and enters a cylinder block and head 56. While the coolant is in the engine block, it enters one or more of the passages, as described further below, and coolant is supplied to the cylinders of the internal combustion engine 10. The coolant exits the cylinder block and head 56 and enters the thermostat housing 58. If the coolant is above a threshold temperature the coolant that exits the thermostat housing 58 will be routed to a radiator 60 for cooling. If the coolant is below a threshold temperature the coolant that exits the thermostat housing 58 will be routed through a bypass circuit 62 back to the water pump. The water pump 52 may optionally pump the coolant into and after cooler 64 for an optional turbo (not shown). In certain embodiments, the coolant after exiting the after cooler 64 may mix with coolant leaving oil cooler prior to entering the cylinder block and head 56. In other embodiments, the coolant after exiting the after cooler 64 may be directed to the thermostat housing 58.

Returning to FIG. 1, the internal combustion engine 10 includes a cylinder head 300 attached to an engine block 200. The engine block 200 includes a chamber that forms a liner bore 214. The liner bore 214 is lined with a cylinder liner 100. As used herein, a liner bore 214 that is lined with a cylinder liner 100 may be referred to as a cylinder assembly or simply as a cylinder. The cylinder liner 100 includes an interior surface 120 that defines a cylinder bore 106 configured to house a piston 212 that, during operation of the internal combustion engine 10, moves within the cylinder bore 106 in a reciprocating fashion. The area defined by the cylinder bore 106 of the cylinder liner 100, the cylinder head 300, and the piston 212 forms a combustion chamber 216. In the combustion chamber 216, a mixture of air and fuel is burned providing the power to drive the piston 212 away from the cylinder head 300. The cylinder head 300 includes at least one valve 302 that allows for one or more functions selected from intake of air into the combustion chamber 216, intake of fuel into the combustion chamber 216, and expulsion of exhaust gases from the combustion chamber 216. Suitable types of internal combustion engines include spark ignition engines or compression ignition engines (e.g., a diesel fuel engine or a dual fuel engine). The internal combustion engine 10 may include any number of cylinders. Each of the cylinders of the internal combustion engine 10 may individually have a single cylinder head 300. Alternatively, 2 or more cylinders may be associated with the cylinder head 300.

When housed in the liner bore 214, the cylinder liner 100, in conjunction with the liner bore 214, forms a first annular coolant channel 250 and a second annular channel 252 below the first annular coolant channel 250 that allow for the passage of a coolant to cool the cylinder liner 100. The coolant is pumped within the internal combustion engine 10 through coolant passages and each of the first annular coolant channel 250 and a second annular coolant channel 252 may be fed from one or more coolant passages 254 (out of plane and shown in relief). The one or more coolant passages 254 may be configured to received coolant from the cylinder head 300. For example, the one or more coolant passages 254 may receive coolant from the cylinder head water jacket (not shown). Suitable coolants include, but are not limited to, water, glycol, or a mixture thereof.

Figure 3:
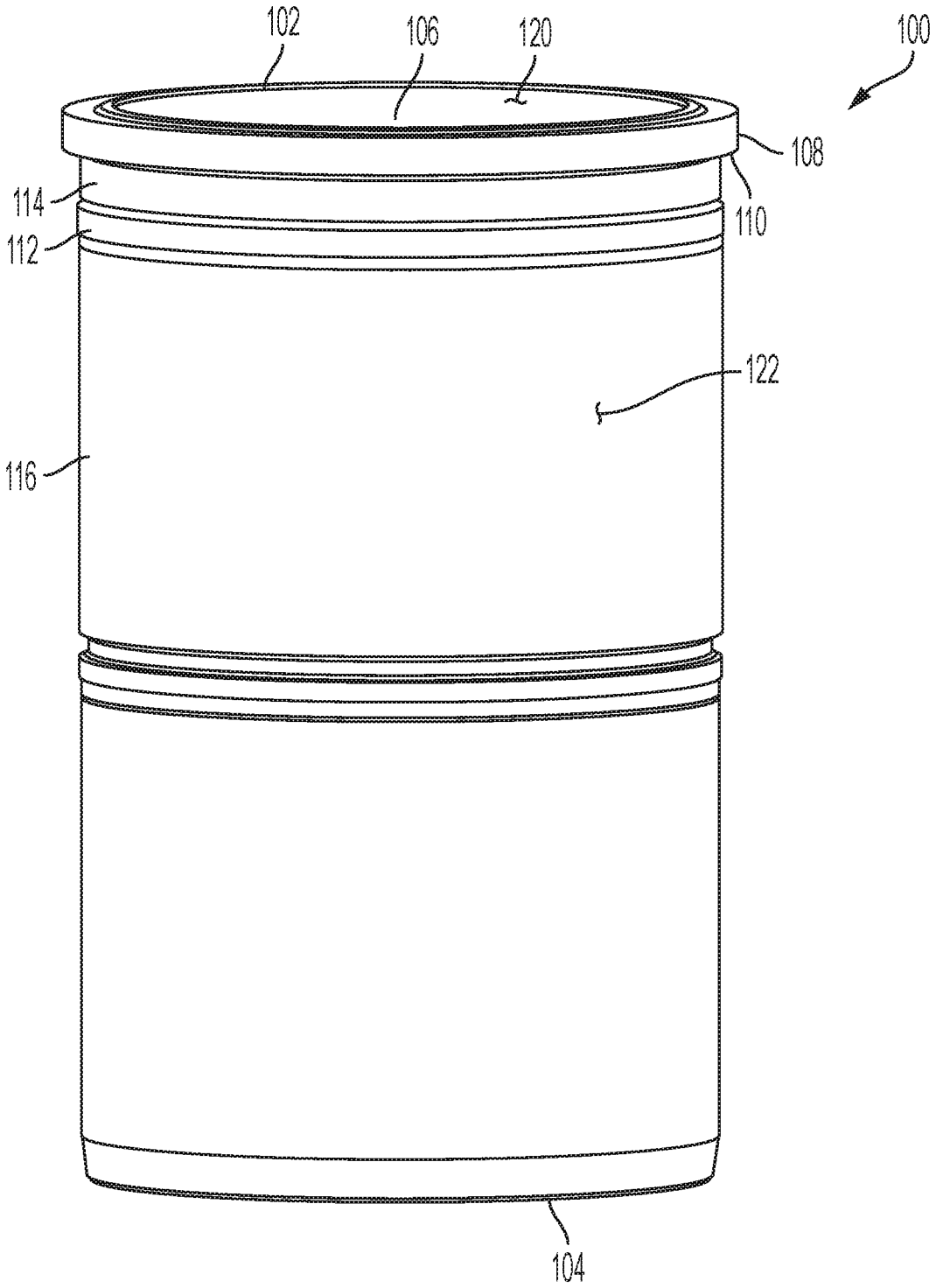
FIG. 3 is a perspective view of an embodiment of an exemplary cylinder liner.

FIG. 3 is a perspective view of an exemplary embodiment of the cylinder liner 100. The cylinder liner 100 has a hollow, generally cylindrical body that includes a top end 102 and a bottom end 104. Cylinder liner 100 includes cylinder bore 106 that spans longitudinally through the center of the cylinder liner 100, from the top end 102 to the bottom end 104. As indicated above, the cylinder bore 106 is defined by the interior surface 120. The cylinder liner 100 also includes an exterior surface 122 that is opposite and parallel to the interior surface 120. Located at the top end 102 is an annular flange 108 protruding radially outward from the exterior surface 122 of the cylinder liner 100. The annular flange 108 may be configured to rest in the recessed area 204 of the engine block 200. As shown in FIG. 1, the engine block 200 includes a recessed area 204 that supports the annular flange 108 of the cylinder liner 100. The recessed area 204 allows the annular flange 108 of cylinder liner 100 to be situated lower than the surface of an engine block deck 220. Accordingly, the annular flange 108 of cylinder liner 100 is counter sunk into the engine block 200

The cylinder liner 100 also includes an annular ridge 112 protruding radially outward from the cylindrical body of the cylinder liner 100. The annular ridge 112 may also be referred to as the pilot diameter. The annular ridge 112 separates the cylindrical body of cylinder liner 100 to form a first cylindrical section 114 and a second cylindrical section 116. The first cylindrical section 114 spans the length of the cylinder liner 100 between the annular flange 108 and the annular ridge 112. When the cylinder liner 100 is housed in the liner bore 214 of the engine block 200, the first annular coolant channel 250 is formed to allow the passage of a coolant around the cylinder liner 100 at the first cylindrical section 114. The first cylindrical section 114 has a smooth surface. The smooth surface of the first cylindrical section 114 may transition to each of the annular flange 108 and annular ridge 112 via a radiused corner.

Similar to the first cylindrical section 114, when the cylinder liner 100 is housed in the liner bore 214 of the engine block 200, a second annular coolant channel 252 is formed to allow the passage of a coolant around the cylinder liner 100 at the second cylindrical section 116. The second cylindrical section 116 has a smooth surface. The smooth surface of the second cylindrical section 116 may taper to meet the annular ridge 112. The cylinder liner 100 may be made from any suitable material or materials, such as for example, from an alloyed gray iron, aluminum, or steel (e.g., stainless steel).

Figure 4:
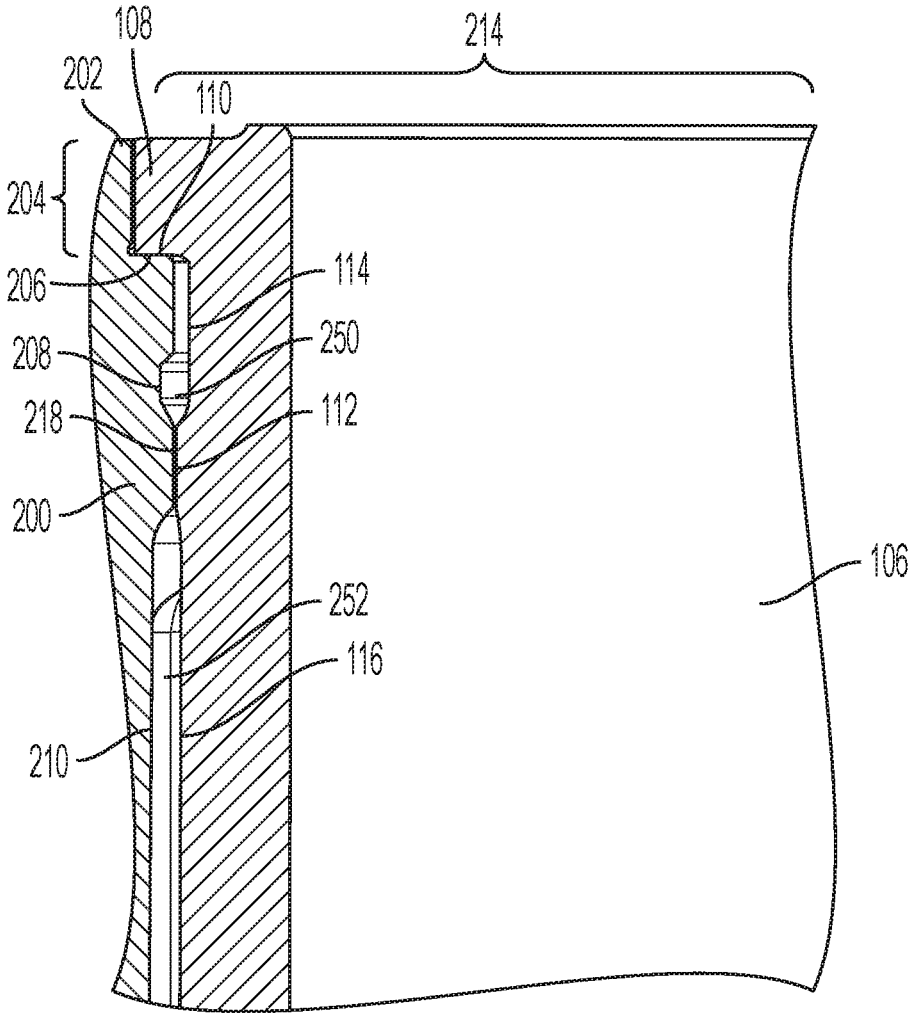
FIG. 4 is a partial cross section view of the cylinder liner and the engine block of FIG. 1.

FIG. 4 is a partial cross section view of the cylinder liner 100 and the engine block 200 and best shows the interfaces where the annular ridge 112 and the annular flange 108 meet the liner bore 214 of the engine block 200. As indicated above, engine block 200 includes a recessed area 204. Situated at the bottom of recessed area 204 is a radially-extending, upward facing shoulder 206. Below the radially-extending, upward facing shoulder 206 in the liner bore 214 of engine block 200 is a liner bore ridge 218. Situated between the recessed area 204 and the liner bore ridge 218 is a liner bore groove 208. The liner bore groove 208 may have a continuous shape or non-continuous shape (e.g., it may vary in shape or size). Situated below the liner bore ridge 218 of the engine block 200 is an inner surface of the liner bore 210.

The annular flange 108 of the cylinder liner 100 includes a lower face 110. When the cylinder liner 100 is inserted into the liner bore 214, the lower face 110 of the cylinder liner 100 engages the a radially-extending, upward facing shoulder 206 of the engine block 200. Further, the annular ridge 112 of the cylinder liner 100 engages the liner bore ridge 218. The first annular coolant channel 250 is formed between the first cylindrical section 114 of the cylinder liner 100 and the cylinder bore groove 208. In certain embodiments, the first cylindrical section 114 and the cylinder bore groove 208 do not come into contact with each other within the first annular coolant channel 250. The radially-extending, upward facing shoulder 206 and the lower face 110 engage to form an interface that defines the top of the top of the first annular coolant channel 250. The lower face 110 of the cylinder liner 100 and the radially-extending, upward facing shoulder 206 of the engine block 200 are machined to form smooth surfaces. Accordingly, when coolant flows through the first annular coolant channel 250, coolant is retained within the first annular coolant channel 250 without the need for a secondary seal (e.g., sealing is provided only by the interfaces between the cylinder liner and the cylinder bore). This provides the ability for the first annular coolant channel 250 to be situated closer to the top end 102.

The second annular coolant channel 252 is formed between the second cylindrical section 116 of the cylinder liner 100 and the inner surface of the liner bore 210. When the cylinder liner 100 is inserted into the liner bore 214, an interface is formed between the liner bore ridge 218 and the annular ridge 112 of the cylinder liner 100. The interface between the liner bore ridge 218 and the annular ridge 112 forms a seal and separates the first annular coolant channel 250 and second annular coolant channel 252. While liner bore ridge 218 and the annular ridge 112 forms a seal, in certain conditions, for example during use in extremely cold temperatures, the seal may allow some cross talk of coolant between the first annular coolant channel 250 and the second annular coolant channel 252. In certain embodiments, an incomplete seal may be desired if cross talk of coolant between channels 250 and 252 is desired to prevent stagnation. The second annular coolant channel 252 may terminate at the bottom with an external seal (not shown).

Figure 5:
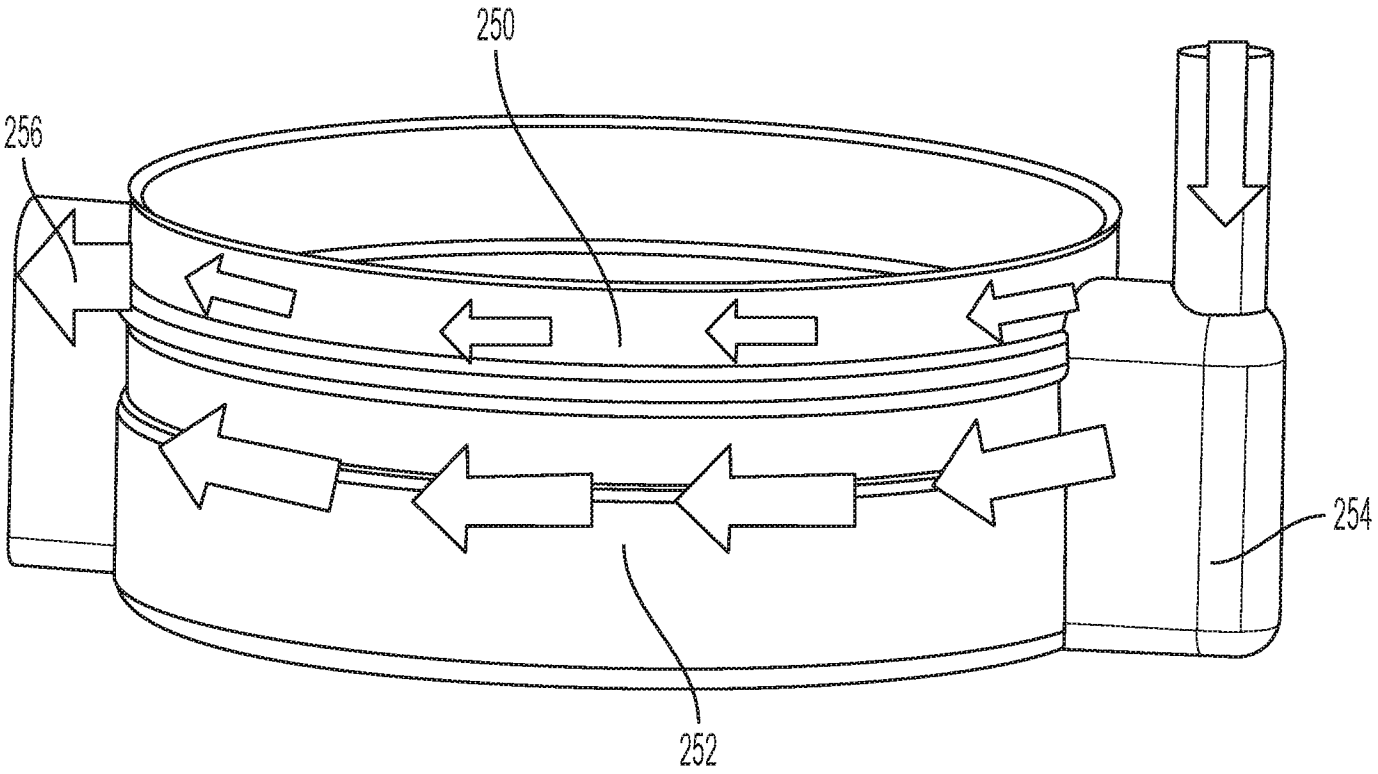
FIG. 5 is a diagram showing the flow of a coolant through the channels formed by the cylinder liner.

FIG. 5 is a diagram showing the flow of a coolant shown by arrows through the channels formed by the cylinder liner 100 and the engine block 200. The diagram in FIG. 5 is a relief of the flow path of the coolant. The coolant enters the one or more coolant passages 254 from one or more coolant flow passages in the internal combustion engine 10. The coolant exits the one or more coolant passages 254 and moves around the cylinder though the first annular coolant channel 250 and second annular coolant channel 252 to exit though the outlet 256. A similar coolant flowpath exists on the opposite side of the diagram where coolant similarly exits the one or more coolant passages 254 and moves around the cylinder though the first annular coolant channel 250 and second annular coolant channel 252 to exit though the outlet 256. The outlet 256 may communicate to allow the coolant to exit into a second cylinder (not shown), where it can assist in the cooling of one or more additional cylinders, or out of the engine block 200, where it can assist in the cooling of the cylinder head or be cooled and recycled back into the cylinder.

Figure 6:
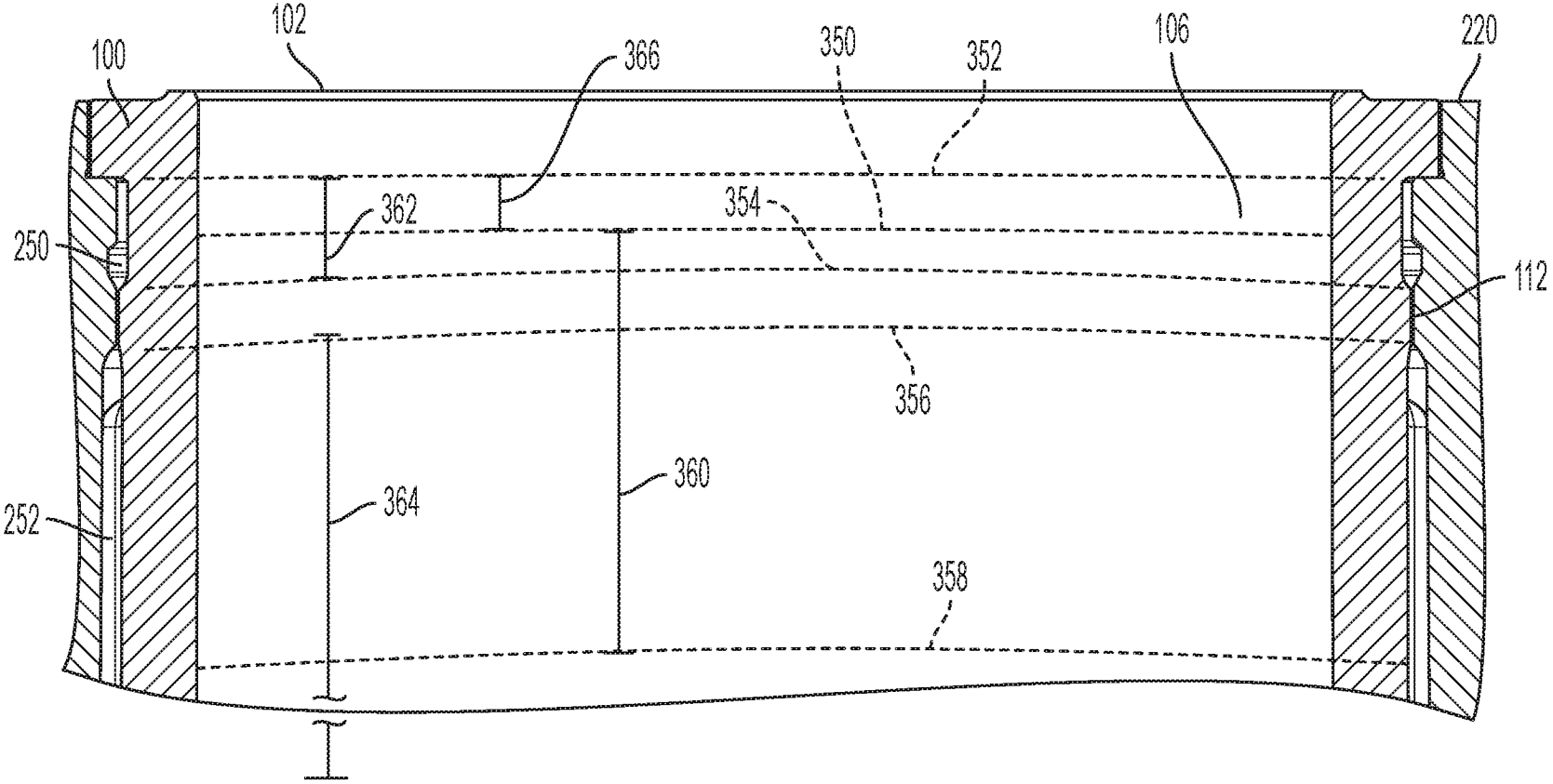
FIG. 6 is a cross section view of the cylinder liner and the engine block of FIG. 1.

FIG. 6 is a cross section view of the cylinder liner 100 housed in the engine block 200. Dashed lines have been be included in the FIG. 6 to describe the height and location of the first annular coolant channel 250 and the second annular coolant channel 252 in relation to the path of the piston between top dead center 350 and bottom dead center 358. The distance between top dead center 350 and bottom dead center 358 is shown with a bracketed line and may be referred to as the piston stroke 360. Also shown is a bracketed line showing the distance between the top dead center 350 and the top of the first channel 352, which may be referred to as the distance to the first channel 366. The top of the first channel 352 is closer to the top end 102 of the cylinder liner 100 than top dead center 350. Dashed lines are shown for a top of the first channel (i.e., first channel top end) 352 and the bottom of the first channel (i.e., first channel bottom end) 354. A bracketed line is shown for a first channel height 362. Similarly, dashed lines are shown for a top of the second channel (i.e., second channel top end) 356 and a bracketed line is shown for a second channel height 364. The bottom of the first channel 354 and the top of the second channel 356 flank the annular ridge 112. The top dead center 350 is closer to the top end 102 of the cylinder liner 100 than the annular ridge 112.

INDUSTRIAL APPLICABILITY

The disclosed cylinder liner or cylinder liner and engine block assembly may be used in any application where it is desired to increase the reliability and operating life of the associated engine. In the disclosed embodiment, the cylinder liner includes a first coolant channel and a second coolant channel. Due to the location of the first channel being in particularly close proximity to the top of the cylinder, the coolant can achieve better access to locations on the cylinder liner that are exposed to higher levels of heat from combustion. The second channel may provide cooling to the remaining portions of the cylinder liner. Accordingly, the disclosed cylinder liner allows for the management and removal of heat generated during combustion without the need for sacrificing the durability of the cylinder liner.

It will be appreciated that the foregoing description provides examples of the disclosed system and technique. However, it is contemplated that other implementations of the disclosure may differ in detail from the foregoing examples. All references to the disclosure or examples thereof, are intended to reference the particular examples being discussed at that point and are not intended to imply any limitation as to the scope of the disclosure more generally. All language of distinction and disparagement with respect to certain features is intended to indicate a lack of preference for those features, but not to exclude such from the scope of the disclosure entirely unless otherwise indicated.

ELEMENT LIST

| Element Number | Element Name |
|---|---|
| 10 | internal combustion engine |
| 50 | cooling system |
| 52 | water pump |
| 54 | oil cooler |
| 56 | cylinder block and head |
| 58 | thermostat housing |
| 60 | radiator |
| 62 | bypass circuit |
| 64 | cooler |
| 100 | cylinder liner |
| 102 | top end |
| 104 | bottom end |
| 106 | cylinder bore |
| 108 | annular flange |
| 110 | lower face |
| 112 | annular ridge |
| 114 | first cylindrical section |
| 116 | second cylindrical section |
| 120 | interior surface |
| 122 | exterior surface |
| 200 | engine block |
| 204 | recessed area |
| 206 | upward facing shoulder |
| 208 | liner bore groove |
| 210 | liner bore |
| 212 | piston |
| 214 | liner bore |
| 216 | combustion chamber |
| 218 | liner bore ridge |
| 220 | engine block deck |
| 250 | first annular coolant channel |
| 252 | second annular coolant channel |
| 254 | coolant passages |
| 256 | outlet |
| 300 | cylinder head |
| 302 | at least one valve |
| 350 | top dead center |
| 352 | top of the first channel |
| 354 | bottom of the first channel |
| 356 | top of the second channel |
| 358 | bottom dead center |
| 360 | piston stroke |

-continued

| ELEMENT LIST | |
|---|---|
| Element Number | Element Name |
| 362 | first channel height |
| 364 | second channel height |
| 366 | distance to the first channel |

What is claimed is:

1. An internal combustion engine, comprising:

a cylinder head;

a piston; and an engine block having a liner bore and a cylinder liner countersunk into the liner bore, wherein a first annular coolant channel having a channel top end and a channel bottom end is formed between the liner bore and the cylinder liner, wherein the liner bore includes a liner bore ridge that protrudes from the liner bore and a liner bore groove that is recessed into the liner bore so as to form a widest portion of the first annular coolant channel near the channel bottom end;

the cylinder liner comprising:

a cylindrical body having a central longitudinal axis, a cylinder bore housing the piston, the piston slideably received within the cylinder bore for reciprocating between a top dead center position and a bottom dead center position along the central longitudinal axis;

an annular ridge that protrudes radially outward from the cylindrical body relative to the central longitudinal axis, wherein the liner bore ridge protrudes radially toward the annular ridge, a top end having an annular flange, and a first cylindrical section of the cylindrical body spanning a length between the annular ridge and the annular flange, the first annular coolant channel being formed between a portion of the liner bore that includes the liner bore groove and the first cylindrical section, wherein the channel top end is closer to the top end of the cylinder liner than the piston when the piston is at the top dead center position.

2. The internal combustion engine of claim 1, wherein the top dead center position of the piston is directly above the liner bore groove.

3. The internal combustion engine of claim 1, wherein the cylinder liner and the liner bore form a second annular coolant channel below the first annular coolant channel.

4. The internal combustion engine of claim 3, wherein the engine block includes a coolant passage that is configured to accept coolant from the cylinder head and feed the coolant into the first annular coolant channel and the second annular coolant channel.

5. The internal combustion engine of claim 1, wherein the engine block includes a recessed area with an upward facing shoulder, the annular flange of the cylinder liner forms an interface with the upward facing shoulder, and the liner bore groove is provided between the liner bore ridge and the recessed area.

6. The internal combustion engine of claim 5, wherein the interface between the annular flange and the upward facing shoulder is a sealing interface capable of retaining coolant in the first annular coolant channel.

7. The internal combustion engine of claim 6, wherein there is no external seal between the cylinder liner and the liner bore above the channel top end.

8. The internal combustion engine of claim 1, wherein the annular flange of the cylinder liner is at least partially positioned lower than a surface of a deck of the engine block.

9. The internal combustion engine of claim 1, wherein the annular ridge of the cylinder liner forms an interface with the liner bore ridge.

10. The internal combustion engine of claim 9, wherein the cylinder liner forms a second annular coolant channel, the interface is provided between the first annular coolant channel and the second annular coolant channel, and wherein the interface is configured to allow cross-talk of coolant between the first annular coolant channel and the second annular coolant channel.

11. The internal combustion engine of claim 9, wherein the top dead center position of the piston is closer to the top end of the cylinder liner than the annular ridge of the cylinder liner.

12. The internal combustion engine of claim 9, wherein the top dead center position of the piston is above the annular ridge of the cylinder liner, and closer to the annular flange than the annular ridge.

13. An internal combustion engine, comprising:

a cylinder head;

a piston; and an engine block having a liner bore and a cylinder liner positioned within the liner bore, wherein a first annular coolant channel having a channel top end and a channel bottom end is formed between the liner bore and the cylinder liner, and a second annular coolant channel is formed between the liner bore and the cylinder liner at a location beneath the first annular coolant channel, wherein the liner bore includes a liner bore ridge that protrudes from the liner bore and a liner bore groove that is recessed into liner bore so as to form a widest portion of the first annular coolant channel near the channel bottom end;

the cylinder liner comprising:

a cylindrical body having a central longitudinal axis, a cylinder bore housing the piston, the piston slideably received within the cylinder bore for reciprocating between a top dead center position and a bottom dead center position along the central longitudinal axis;

an annular ridge that protrudes radially outward from the cylindrical body relative to the central longitudinal axis, wherein the liner bore ridge protrudes radially toward the annular ridge, and wherein the liner bore ridge and the annular ridge are provided between the first annular coolant channel and the second annular coolant channel;

a top end having an annular flange;

a first cylindrical section of the cylindrical body spanning a length between the annular ridge and the annular flange, wherein the first annular coolant channel is formed between a portion of the liner bore that includes the liner bore groove and the first cylindrical section; and a second cylindrical section of the cylindrical body, wherein the annular ridge separates the first cylindrical section and the second cylindrical section, and wherein the second annular coolant channel is formed between the liner bore and the second cylindrical section;

wherein the annular ridge forms an interface with the liner bore ridge, wherein the interface is configured to allow cross-talk of coolant between the first annular coolant channel and the second annular coolant channel, and wherein the channel top end is closer to the top end of the cylinder liner than the top dead center position of the piston.

14. The internal combustion engine of claim 13, wherein each of the first cylindrical section and the second cylindrical section of the cylinder liner have a smooth surface.

15. The internal combustion engine of claim 13, wherein the annular flange is configured to form a sealing interface with an upward facing shoulder of the engine block.

16. A cooling system for an internal combustion engine, the cooling system comprising:

a water pump;

an oil cooler in fluid communication with the water pump; and an engine block and cylinder head assembly, the engine block and cylinder head assembly comprising:

a cylinder head;

a piston; and an engine block having a liner bore and a cylinder liner countersunk into the liner bore, wherein a first annular coolant channel having a channel top end and a channel bottom end is formed between the liner bore and the cylinder liner, wherein the liner bore includes a liner bore ridge that protrudes from the liner bore and a liner bore groove that is recessed into the liner bore so as to form a widest portion of the first annular coolant channel near the channel bottom end;

wherein the cylinder liner comprises:

a cylindrical body having a central longitudinal axis, a cylinder bore housing the piston, the piston capable of a piston stroke along the central longitudinal axis that includes a top dead center position;

a top end having an annular flange;

a first cylindrical section of the cylindrical body;

a second cylindrical section of the cylindrical body; and an annular ridge that protrudes radially outward from the cylindrical body relative to the central longitudinal axis and separates the first cylindrical section and the second cylindrical section, wherein:

the first cylindrical section of the cylindrical body spans a length between the annular ridge and the annular flange, the first annular coolant channel is formed between a portion of the liner bore that includes the liner bore groove and the first cylindrical section, and the channel top end is closer to the top end of the cylinder liner than the top dead center position of the piston.

17. The cooling system of claim 16, wherein each of the first cylindrical section and the second cylindrical section of the cylinder liner have a smooth surface.

18. The cooling system of claim 16, wherein a second annular coolant channel is formed below the annular ridge and between the liner bore and the second cylindrical section.

19. The cooling system of claim 18, wherein the engine block includes a recessed area with an upward facing shoulder, wherein:

the annular flange of the cylinder liner forms a sealing interface with the upward facing shoulder, the liner bore groove is provided between the recessed area and the liner bore ridge, the annular ridge of the cylinder liner forms an interface with the liner bore ridge, and the interface between the annular ridge and the liner bore ridge has a gap configured to allow cross-talk between the first annular coolant channel and the second annular coolant channel.

20. The cooling system of claim 19, wherein the top dead center position of the piston is closer to the top end of the cylinder liner than the annular ridge of the cylinder liner.

* * * * *